US005634666A

United States Patent [19]

Lee

[11] Patent Number: 5,634,666

[45] Date of Patent: Jun. 3, 1997

[54] BINDER WITH COVER SPACER

[76] Inventor: Dong H. Lee, 12708 Picket Rope La., Austin, Tex. 78727

[21] Appl. No.: 401,009

[22] Filed: Mar. 9, 1995

[51] Int. Cl.[6] ..... B42F 13/00

[52] U.S. Cl. ..... 281/20; 281/29; 402/73; 402/80 R

[58] Field of Search ..... 281/15.1, 18, 20, 281/29, 37, 51; 402/70, 73, 80 R, 502

[56] References Cited

U.S. PATENT DOCUMENTS

| | | | |
|---|---|---|---|
| 4,531,764 | 7/1985 | Chang | 402/80 R X |
| 4,744,689 | 5/1988 | Sternberg | 281/29 X |
| 4,997,207 | 3/1991 | Feldman | 281/73 X |
| 5,002,416 | 3/1991 | Serzen | 402/73 X |
| 5,398,971 | 3/1995 | Ayele | 281/29 X |

*Primary Examiner*—Frances Han

*Attorney, Agent, or Firm*—Roddy M. Bullock

[57] ABSTRACT

A binder with cover spacer which restrains the covers of a binder in a near-parallel relationship to enable the binder to be stored in a stacked or shelved manner. The binder of the invention is comprised of a back portion, or spine, which determines the width of the closed binder, and generally two covers hingedly attached to the spine. The cover spacer of the invention comprises a first base portion affixed to one of the covers of the binder near the distal, or outer, edge of the cover. A stand-off element is hingedly attached to the first base portion, such that the stand-off element is moveable from a position approximately parallel to the cover, essentially laying flat against the cover, to a position approximately perpendicular to the cover. A second base portion is affixed to the other cover in a position generally opposite to the first base portion. The second base portion has a clasp or catch arrangement such that the distal end of the stand-off device in the perpendicular position engages the clasp or catch arrangement, thereby providing a rigid support which spaces and restrains the covers in a near parallel position.

6 Claims, 4 Drawing Sheets

BINDER WITH COVER SPACER

TECHNICAL FIELD OF THE INVENTION

The present invention relates to binders, and more particularly to binders having spacing means for making the binders self-supporting in a closed position for ease of stacking and shelving.

BACKGROUND OF THE INVENTION

Binders and similar devices, sometimes called loose-leaf binders or notebooks, are well known in the prior art. Such binders typically have a "backbone" element, commonly called a spine, two covers which are hingedly attached to the spine, and mechanisms or means whereby loose leaf sheets may be inserted, secured, or removed quickly and easily. Probably the most common is the "three-ring" binder, which has three openable rings attached to the spine which fit through three corresponding holes punched into the loose leaf sheets, thereby securing the sheets into the binder.

One of the problems associated with the use of binders is in their inherent configuration when closed which can best be described as a wedge. If the binder is not full of papers, the wedge is formed with the spine forming the widest part, tapering to somewhat of a point where the outer edges of the covers meet. When storing such binders, either by stacking or shelving, the inherent wedge configuration makes the stored binders unstable and awkward. When stacked, unless the wedge shape is alternated, and binders of similar size are being stacked, the stack quickly starts to fall. When several binders are shelved, the difference between the width at the spine and the width at the outer edge of the covers makes the group of binders tend to fall over to one side as well.

Since loose leaf binders are quite common and find great utility in many areas including business, education and home use, and since binders are rarely full such that the covers maintain a generally parallel configuration, there is a great need for an economical, easy to use method or means of retaining a binder in a configuration which allows easy stacking or shelving. Such a method or means would tend to keep the covers more or less parallel when less than full. Then the binders would stack or shelve in a similar manner as books.

There have been several approaches to solving the problem of the asymmetrical configuration due to the nonparallel arrangement of the covers of the binder. U.S. Pat. No. 4,997,207 to Feldman issued for a notebook cover restraining system and method of use. The Feldman patent teaches the use of a short extension attached to one notebook cover, the short extension and other cover having complimentary hook structures which may be engaged to restrain the binder covers in a near parallel arrangement. While the Feldman invention is quite satisfactory in most respects it does have some drawbacks. One drawback is that the short extension of the invention folds outward, away from the spine of the binder, such that it adds dimensionally to the size of the binder cover to which it is attached. This is a problem when using the binder in a small area with limited space. Another drawback is the relative difficulty of manufacture and adaptability to existing binders. It seems that the invention must be built into the binder at the time of manufacture.

Another approach to solving the problem of interest is presented by Serzen in U.S. Pat. No. 5,002,416 for a cover spacer for binders. The Serzen invention teaches a spacing element extending substantially transversely from a base portion which is affixed to one of the binder covers. The spacing element may be adjustable for sizing to different size binders. One drawback of the Serzen invention is the interference of the spacer elements with the usefulness of the binder when open. The spacer elements are shown typically as rigid rods which remain in the same position at all times, and would tend to interfere with typical uses of binders, such as when trying to write on sheets held in the binder.

Another similar approach as Serzen's is U.S. Pat. No. 5,267,804 to Baumgarten. The Baumgarten invention uses a rigid apparatus of right angled side walls connected to a right angled bottom wall, the apparatus being affixed to a corner of a binder cover. The apparatus is sized such that in the closed position the binder covers are generally parallel. The Baumgarten invention has similar drawbacks as the Serzen invention, namely that the spacers would tend to interfere with the use of the binder in its intended use when open.

Still another approach to solving the problem of interest is the invention of Thomas which is generally shown in either of U.S. Pat. Nos. 4,524,991 or 4,569,613, both of which teach a snap on device for hard cover ring binders. The Thomas invention is external and separate from the binder, and is attached when needed. The U-shaped snap on device acts as a spacer and a support, which, when in use restrains the binder covers in generally parallel positions. Some drawbacks to the Thomas inventions are that the device must necessarily be sized to the binder it is to be used with, and the device necessarily adds dimensionally to the width of the binder due to the portion of the device which fits over the outside of the binder covers. The portion of the invention which extends over the outside covers causes the width of the binder at the edge of the covers to be slightly wider than the spine, causing storage difficulties. As well, the general inconvenience of having to have a wholly separate device to accomplish the purpose of making storage of binders easier is a drawback to the Thomas inventions because the device would tend to be misplaced or lost when not being used.

There is a need, therefore, for an invention which serves to easily and economically restrain the covers of binders in a generally parallel position for ease of stacking or shelving. The invention should be integral to the binder; either being manufactured into the binder or being permanently affixed to an existing binder. The invention should also provide for the use of the binder when open without interference of the invention. And the invention should not add to the outer dimensions of the binder such that the binder is made more difficult to use or store.

SUMMARY OF THE INVENTION

The instant invention provides for an easy to manufacture, easy to use binder with cover spacer which restrains the covers of the binder in a near parallel relationship for easy storage. The cover spacer of the invention may be made integral to the binder covers, or may be affixed to existing binder covers. The spacer of the invention does not interfere with use of the binder, and fits wholly within the outer dimensions of the binder.

The binder of the invention is comprised of a back portion, or spine, which determines the width of the closed binder, and generally two covers hingedly attached to the spine. The spine generally has attached to it some apparatus or device for retaining loose leaf sheets and such, although such apparatus is not necessary for the cover spacer of the invention.

The cover spacer of the invention comprises a first base portion affixed to one of the covers of the binder near the distal, or outer, edge of the cover. A stand-off element is hingedly attached to the first base portion, such that the stand-off element is moveable from a position approximately parallel to the cover, essentially laying flat against the cover, to a position approximately perpendicular to the cover. A second base portion is affixed to the other cover in a position generally opposite to the first base portion. The second base portion has a clasp or catch arrangement such that the distal end of the stand-off device in the perpendicular position engages the clasp or catch arrangement, thereby providing a rigid support which spaces and restrains the covers in a near parallel position.

The stand-off element may be made as long as necessary, but it will generally be slightly less in length than the width of the spine. When not in use, the stand-off element may be folded down such that it lays nearly flat next to the cover, thereby not interfering with the normal use of the binder.

The cover spacer according to a preferred embodiment of the invention includes a stand-off element made of formed metal or plastic rod, the first base portion having a hinge means for connecting to the stand-off element, as well as a clip means to keep the stand-off element in the folded flat position. The clasp of the second base portion is made of formed metal or plastic in a way as to require the stand-off element to be forcibly engaged in a secure locking position.

It may be necessary to use more than one cover spacer, although for most uses, one is sufficient. The cover spacers are preferably arranged near the distal edges of the binder covers, but may as well be located on the top or bottom edges of the covers.

DETAILED DESCRIPTION OF THE INVENTION

The invention is now described with reference to the drawings to more particularly point out and carefully delineate the particular features of a preferred embodiment of the invention. While the description and drawings contemplate a common three-ring binder, it is understood that the scope of the invention includes any binder, notebook, or other loose-leaf carrier.

Figure 1:
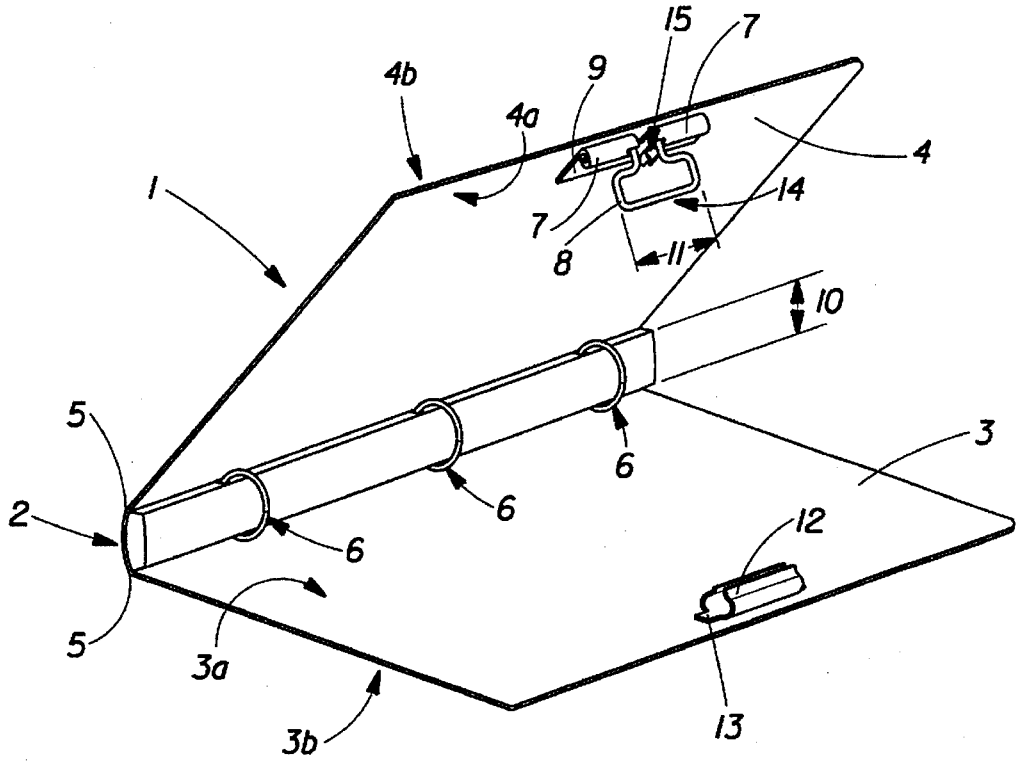
FIG. 1 is a perspective view of a binder with spacer of the invention.

FIG. 1 shows a perspective view of a binder with a spacer of the invention 1. The binder comprises a spine portion 2, as well as two covers, 3 and 4. Cover 3 has an inside 3*a* and an outside 3*b*. Likewise cover 4 has an inside 4*a* and an outside 4*b*. The covers are hingedly attached 5 to the spine 2 such that the binder may open and close like a book. A typical binder has three rings 6 which can be opened and closed so as to retain hole-punched loose-leaf sheets. The spacer of the invention is comprised of a stand-off element 8 which is hingedly attached by hinge means 7 to a base member 9 which is affixed to the inside binder cover 4*a* near the edge distal to the spine 2. The hinge means 7 allows the stand-off member to rotate about the axis of the hinge means 7 so as to move from a closed position where the stand-off element 8 is laying essentially flat against and parallel with the inside cover 4*a* to an open position where the stand-off element 8 is essentially perpendicular to the inside cover 4*a*. The length of the stand-off element 8 is approximately the same as the width 10 of the spine. The width 11 of the stand-off element 8 may be made a dimension appropriate to the size of the binder 1. When the stand-off element 8 is rotated, or folded, into the closed position the preferred embodiment of the invention provides for clip means 15 to restrain the stand-off element 8 in the closed position. A clasp means 12 is affixed by its base 13 to the other inside binder cover 3*a* near the edge distal to the spine 2, and at a position opposite to the stand-off element 8. When the binder covers 3 and 4 are rotated into a closed position, the clasp means 12 engages the distal end 14 of stand-off element 8 when the stand-off element 8 is in the generally perpendicular position with respect to binder cover 4*a*. In this manner the binder covers 3 and 4 are restrained in a generally parallel position with respect to the other. The clasp means 12 may be designed such that essentially zero force is necessary to insert and remove the distal end 14 of stand-off element 8, but the preferred embodiment is a clasp means 12 designed such that some force is necessary to both insert and remove the stand-off element 8.

Figure 2A:
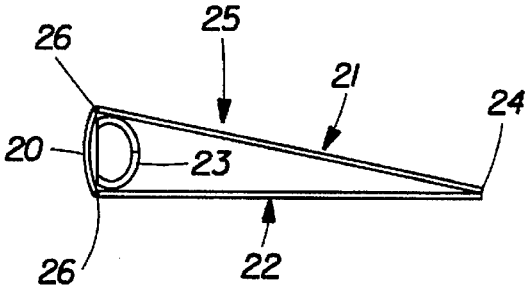
Fig. 2A PRIOR ART
FIG. 2A is a side view of a binder of the prior art showing the inherent wedge shape of such a binder.
Figure 2B:
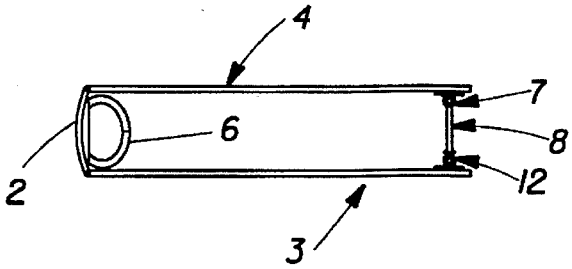
FIG. 2B is a side view of a binder with spacer of the invention showing the covers held in a general parallel position.

FIG. 2A shows a binder of the prior art 25 and illustrates the inherent wedge shape formed when covers 21 and 22 are rotated fully about the spine 20 by hinge means 26. The distal edges of covers 21 and 22 meet at somewhat of a point 24. This wedge configuration is the problem sought to be solved by the instant invention, as shown in FIG. 2B. FIG. 2B shows that when the stand-off element 8 is open in the essentially perpendicular position with respect to the cover 4 and engaged in the clasp means 12, the covers 3 and 4 are restrained in an essentially parallel position.

Figure 3:
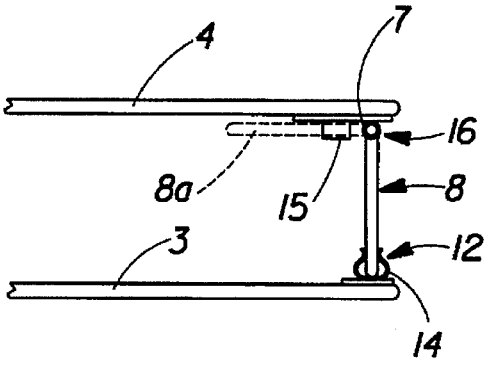
FIG. 3 is a side view detail of one embodiment of the spacer of the invention.
Figure 4:
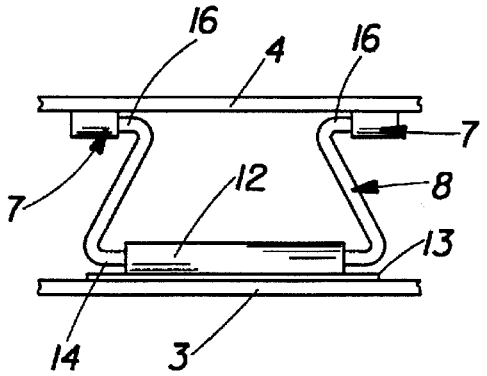
FIG. 4 is a front view detail of one embodiment of the spacer of the invention.

FIGS. 3–6 show various methods and means contemplated for the cover spacer of the invention. FIGS. 3 and 4 show side and front view details of one embodiment of the cover spacer. Stand-off element 8 is formed of metal or plastic in rod form, being bent into basically a modified "U" shape with the bottom of the "U" being the distal end 14 of the stand-off element 8. The proximate ends 16 of the stand-off element 8 are formed so as to bend outward on the same axis. The stand-off element 8 may be rotated into a closed position 8*a* essentially parallel to cover 4. Stand-off element 8 is preferably held into the closed position 8*a* by clip means 15. The clip means 15 may be any of known general means for holding such items, including a spring-action channel which holds the stand-off element 8 by friction, or a spring-action channel similar to that of clasp means 12 and shown in detail in FIG. 7.

Figure 5:
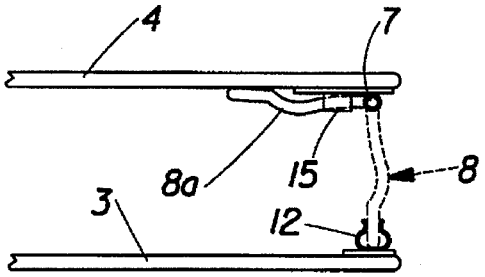
FIG. 5 is a side view detail of an alternative embodiment of the spacer of the invention.

FIG. 5 shows a preferred embodiment for the stand-off element 8. The upright portions or sides of the "U" shape of stand-off element 8 are preferably bent such that they do not lay flat against the cover 4 when rotated into the closed position 8*a*. The bend in the stand-off facilitates easy handling when opening the stand-off element 8 from a closed position, because the bent portion allows a finger grip on the sides of the stand-off element 8.

Figure 6:
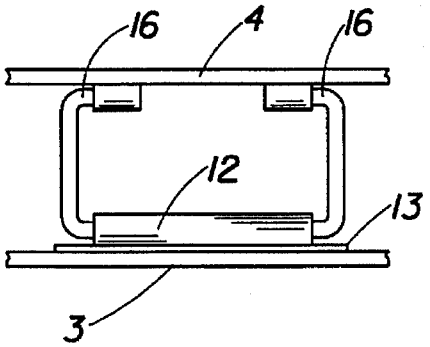
FIG. 6 is a front view detail of an alternative embodiment of the spacer of the invention.

The upright or sides of the "U" shape may be near parallel as shown in the stand-off element 8 of FIG. 6. As shown in FIG. 6, the proximate ends 16 of the stand-off element 8 may bend inwards on the same axis.

Figure 7:
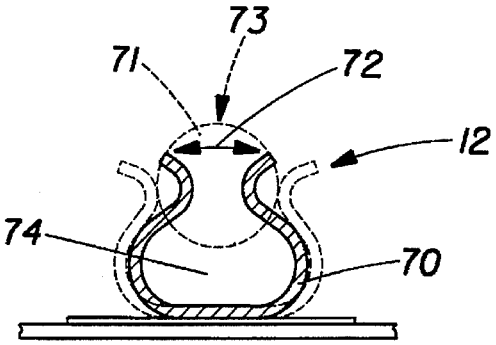
FIG. 7 is a side view cross section of a clasp of the invention.

FIG. 7 shows a detail cross section of a clasp means 12, showing how the clasp means 12 may be formed as an open channel of spring steel 70 which has a mouth portion 71 formed so as to help guide the distal end 14 of the stand-off element 8 into the clasp means 70. The channel narrows to a dimension 72 equal to or less than the diameter of the rod 73 used in forming the stand-off element 8. The dimension 72 is preferably 0.5 to 0.7 times, the diameter of the rod. If the channel dimension 72 is less than the diameter of the distal end 14 of stand-off element 8, then the spring action of the channel design allows the opening to get larger as the distal end 14 of stand-off element 8 is forced through, as shown in the dotted lines of FIG. 7. This spring action provides a positive retaining force once the stand-off element 8 is inserted into clasp means 12. If the channel at 72 is equal to the diameter of the rod used in the distal end 14 of stand-off element 8, then essentially zero insertion force is necessary for insertion or removal of the stand-off element 8 into the clasp means 70. As the channel at 72 becomes narrower, the necessary insertion and removal forces become larger. It is preferable to have a positive force necessary for removal of the stand-off element, since this ensures that the covers of the binder are actually "locked" into a parallel position. Once the stand-off element 8 is inserted completely into the clasp means 70, the distal end 14 of the stand-off element 8 rests secured in the wider portion 74 of the clasp means 12.

Figure 8:
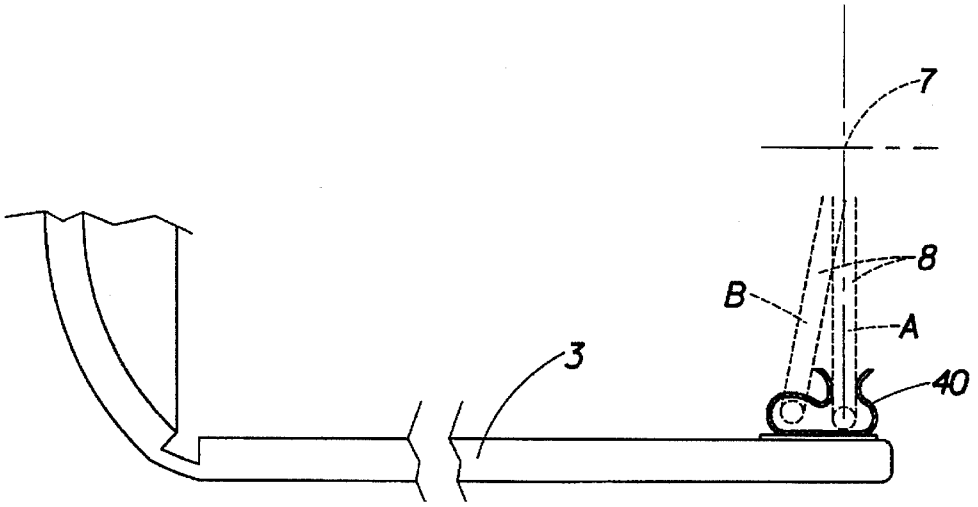
FIG. 8 is a side view cross section of a preferred embodiment of the clasp of the invention

FIG. 8 shows a cross section of a preferred embodiment of the clasp means 12 of the cover spacer as a variation of the principle shown in FIG. 7. As the binder covers 3 and 4 are closed, the stand-off element 8 is inserted into the wide mouth portion of clasp means 40. Once the stand-off element 8 is inserted into the clasp means 40 as shown by the dotted lines "A", it may be forced laterally towards the spine 2 of the binder 1 such that it rests in the position shown by the dotted lines "B". This preferred configuration allows a positive locking mechanism preventing the inadvertent opening of the binder when being stored or transported. Another variant on the preferred configuration is to have the clasp means 40 made such that the stand-off element 8 may be moved either towards the spine as shown in FIG. 8, or away from the spine into an identical arrangement for positive locking.

Figure 9:
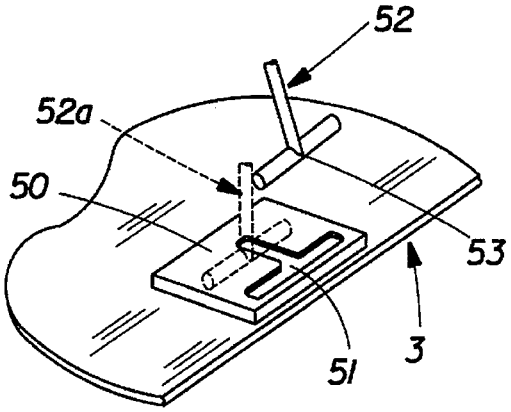
FIG. 9 is a perspective view of an alternative embodiment of the spacer of the invention.
Figure 10:
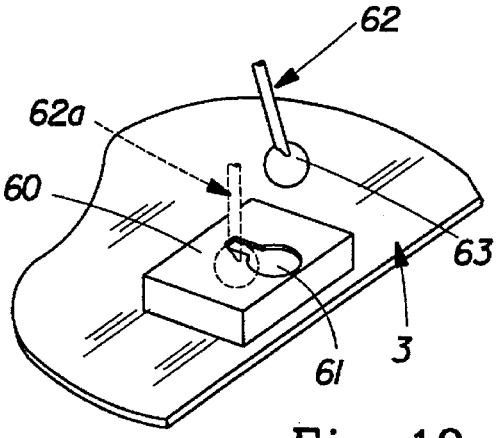
FIG. 10 is a perspective view of another alternative embodiment of the spacer of the invention.

Although a preferred embodiment of the invention has been disclosed, it is understood that many variations of the disclosed invention may be developed without departing from the scope and spirit of the invention. For example, FIGS. 9 and 10 show alternate cover spacer means. FIG. 9 shows a stand-off element comprising a metal or plastic rod 52 in the shape of a "T" at the distal end 53. The clasp means comprises a plate 50 formed such that an opening also in the shape of a "T" 51 is positioned to accept the distal end 53 of the stand-off element 52. Once the distal end 53 of the stand-off element 52 is inserted into the clasp means 50, the stand-off element 52 may be positioned in the secured position shown 52*a*, thus restraining the binder covers 3 and 4 from movement during storage.

FIG. 10 shows a variant of the same principle shown in FIG. 9. The stand-off element comprises a metal rod 62 having a generally spherical member at the distal end 63. The clasp means comprises a plate 60 having an opening 61 shaped to allow insertion of the distal end 63 of the stand-off element 62, and further being shaped such that the stand-off element 62 may be positioned in the secured position 62*a*, thus restraining the binder covers 3 and 4 from movement during storage.

Figure 11:
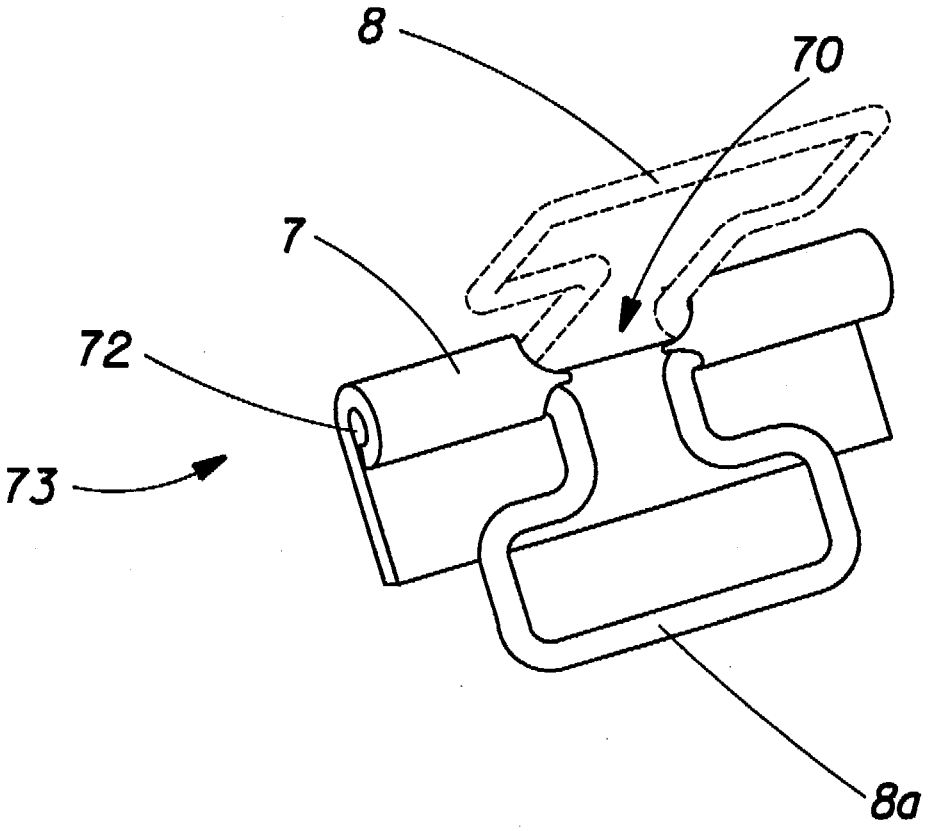
FIG. 11 is a perspective view of a an embodiment of the hinge means of the invention.

FIG. 11 shows an alternate means of providing for hinge means 7 for the metal rod stand-off element 8. The hinge means incorporates at one end a protrusion 70, which due to the spring characteristics of the metal or plastic rod stand-off element 8, forces the stand-off element to occupy either the flat closed position 8*a* or the perpendicular open position 8. This is accomplished due to the spring action of the stand-off element, and the freedom of movement of the proximate end of the stand-off element 72 moving axially along its axis 73. By using this form of hinge means, the clip means 15 of FIGS. 1, 3 and 5 is not necessary.

It is also envisioned that some binders may require more than one cover spacer, and that in some circumstances it may be advantageous to have the cover spacer placed on either the top edge, bottom edge, or both, of the binder covers.

I claim:

1. A binder with at least one spacer comprising:

a binder portion comprising a spine portion, and first and second covers hingedly attached to the spine portion such that the binder portion may open and close, which covers have an inside surface and an outside surface and edges distal to the spine portion;

a spacer member attached to the binder portion, the spacer member comprising:

a. a first base portion adapted to be affixed to the inside surface of the first cover near the edge distal to the spine portion;

b. a stand-off element having the general shape of a modified U proximately connected to the first base portion by hinge means such that the stand-off element may be moveable from a position approximately parallel to the first cover to a position generally perpendicular to the first cover, the stand-off element having a distal end;

c. a second base portion adapted to be affixed to the inside surface of the second cover near the edge distal to the spine portion and opposite to the first base portion; and d. the second base portion having a clasp means wherein the distal end of the stand-off element in the generally perpendicular position may be engaged thereby limiting closure of the binder portion such that the first and second covers are about parallel.

2. The binder with at least one spacer of claim 1 wherein the distal end of the stand-off element may be forcibly engaged in the clasp means thereby restraining the binder in a closed position with the first and second covers about parallel.

3. The binder with at least one spacer of claim 2 wherein the clasp means is formed such that the distal end of the stand-off element may be inserted transversely into the clasp means and moved laterally into a restraining position.

4. The binder with at least one spacer of claim 1 wherein the first base portion includes a clip means such that the stand-off element may be restrained in the position approximately parallel to the first cover.

5. The binder with at least one spacer of claim 1 wherein the stand-off element is formed of bent metal into the general shape of a modified U having a top and a bottom, the top being proximate to the first base portion and cooperating with the hinge means, the bottom being distal to the first base portion and being engagable to the clasp means.

6. A binder with at least one spacer comprising:

a binder portion comprising a spine portion, and first and second covers hingedly attached to the spine portion such that the binder portion may open and close, which covers have an inside surface and an outside surface and edges distal to the spine portion;

a spacer member attached to the binder portion, the spacer member comprising:

a. a first base portion adapted to be affixed to the inside surface of the first cover near the edge distal to the spine portion;

b. a stand-off element having the general shape of a T proximately connected to the first base portion by hinge means such that the stand-off element may be moveable from a position approximately parallel to the first cover to a position generally perpendicular to the first cover, the stand-off element having a distal end;

c. a second base portion adapted to be affixed to the inside surface of the second cover near the edge distal to the spine portion and opposite to the first base portion; and d. the second base portion having a clasp means wherein the distal end of the stand-off element in the generally perpendicular position may be engaged thereby limiting closure of the binder such that the first and second covers are about parallel.

* * * * *